United States Patent [19]

Rodriguez-Cavazos

[11] Patent Number: 4,703,233

[45] Date of Patent: Oct. 27, 1987

[54] TELEVISION RECEIVER HAVING SINGLE POLE DOUBLE THROW ROTARY SWITCH AND CENTERING CIRCUIT

[75] Inventor: Enrique Rodriguez-Cavazos, Indianapolis, Ind.

[73] Assignee: RCA Corporation, Princeton, N.J.

[21] Appl. No.: 4,778

[22] Filed: Jan. 9, 1987

Related U.S. Application Data

[63] Continuation-in-part of Ser. No. 896,033, Aug. 13, 1986, abandoned.

[51] Int. Cl.[4] ..... H01H 21/68; H01J 29/54

[52] U.S. Cl. ..... 315/398; 200/11 G

[58] Field of Search ..... 200/11 R, 11 D, 11 DA, 200/11 E, 11 EA, 11 G, 11 H, 11 J, 11 K, 11 TW, 155 R, 292, 303; 338/163, 164, 174; 315/398

[56] References Cited

U.S. PATENT DOCUMENTS

| | | | |
|---|---|---|---|
| 1,672,123 | 6/1928 | Hartranft | 200/11 G |
| 2,570,960 | 10/1951 | Lutsky et al. | 200/11 K |
| 3,371,167 | 2/1968 | Soulakis, Jr. | 200/11 EA |
| 3,531,603 | 9/1970 | Ashman | 200/11 D |
| 3,566,049 | 2/1971 | Wright | 200/14 |
| 4,195,208 | 3/1980 | Petre | 200/63 R |
| 4,206,334 | 6/1980 | LaRock | 200/291 |
| 4,219,796 | 8/1980 | Nishizawa | 338/163 |

FOREIGN PATENT DOCUMENTS

| | | | |
|---|---|---|---|
| 2028594A | 3/1980 | United Kingdom | 338/163 |

OTHER PUBLICATIONS

HDK sales brochure on variable resistors and tact switches.

*Primary Examiner*—J. R. Scott

*Attorney, Agent, or Firm*—Paul J. Rasmussen; Eric P. Herrmann; Dilip A. Kulkarni

[57] ABSTRACT

A single pole double throw rotary switch includes a non-conductive terminal board. A washer-like wiper element is rotatably secured to the terminal board by a tubular rivet. An outwardly extending portion of the wiper element selectively engages one of a pair of output terminals. When the wiper element occupies a mid-range position, the rotary switch is electrically open. A non-conductive actuating member is rotatably mounted on the terminal board for positioning the wiper element.

14 Claims, 9 Drawing Figures

TELEVISION RECEIVER HAVING SINGLE POLE DOUBLE THROW ROTARY SWITCH AND CENTERING CIRCUIT

This is a continuation-in-part of the U.S. patent application, Ser. No. 896,033, filed on Aug. 13, 1986 now abandoned.

BACKGROUND

A television centering circuit is employed for centering the electron beam raster produced on the kinescope screen with respect to an opening in the TV cabinet. For example, the raster may have to be moved either to the right or to the left to center it relative to the cabinet opening. Conventional centering circuits of this type require some means for selectively connecting an input terminal to one of a pair of output terminals or to neither of them.

One way of achieving the above interconnections is shown in FIG. 1. A jumper connector 10 is used in conjunction with a set of 3 connector stakes A, B and C fixedly disposed on a printed circuit board (PCB) 12. In the position shown in the solid lines, the jumper connector 10 connects the connector stake A with the connector stake B. When the jumper connector 10 is moved to a position depicted by the phantom lines, the connector stake A is connected with the connector stake C. The above jumper connector arrangement is unsuitable for automatic centering operation because of the complicated motions required for moving the connector 10 between the two positions. Another drawback of this arrangement is that if a no-connection position is desired, an extra connector stake is needed. A further deficiency of the jumper connector arrangement is relatively high cost of parts and labor.

Alternately, the interconnections between an input terminal and a pair of output terminals can be accomplished by using a slide switch. The slide switch generally suffers from the same drawbacks—namely, not amenable to automation, lack of a no-connection position and relatively high cost of parts and labor.

SUMMARY OF INVENTION

A single pole double throw rotary switch, in accordance with this invention, includes a non-conductive terminal board. A washer-like conductive wiper element is rotatably secured to the terminal board by means of a tubular rivet. The wiper element selectively engages one of a pair of output terminals. When the wiper element occupies a position intermediate of the two output terminals, the wiper element is electrically disconnected from both the output terminals. To facilitate rotation of the wiper element, an actuating knob is disposed on the same side of the terminal board as the wiper element, and mechanically coupled thereto.

IN THE DRAWINGS

DETAILED DESCRIPTION

Figure 1:
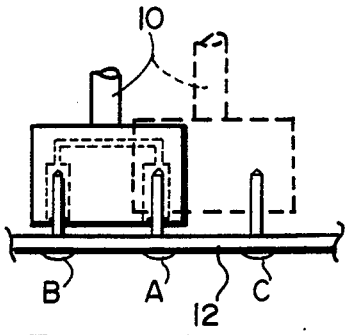
Figure 1 (PRIOR ART)
FIG. 1 is a schematic diagram illustrating a prior art arrangement for selectively connecting an input terminal A to one of two output terminals B and C.
Figure 2:
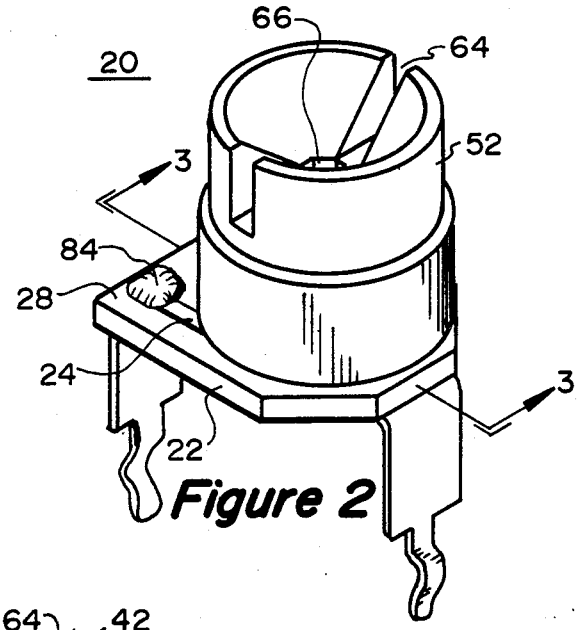
FIG. 2 is a perspective view of a single pole double throw, rotary switch in accordance with this invention.
Figure 3:
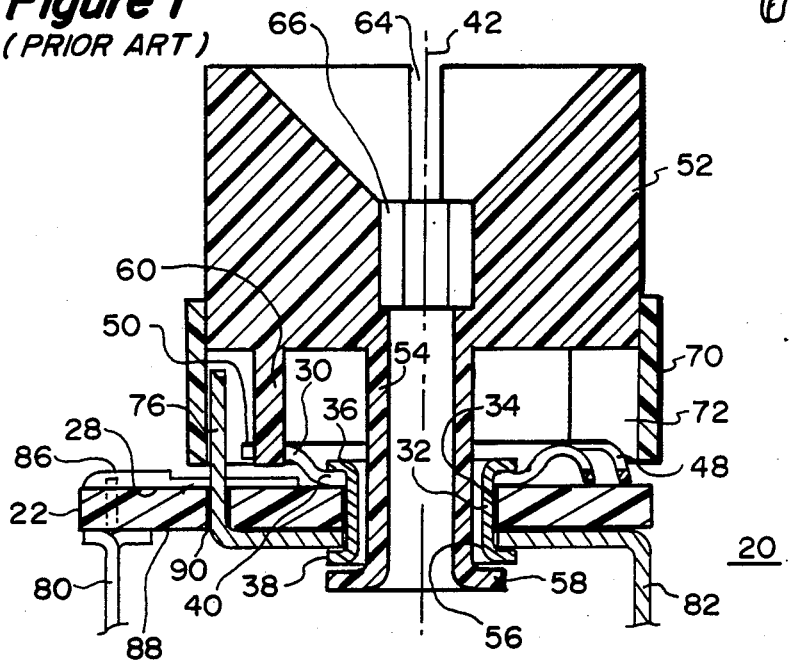
FIG. 3 is a cross-sectional view of the subject rotary switch along a line 3—3 in FIG. 2.
Figure 4:
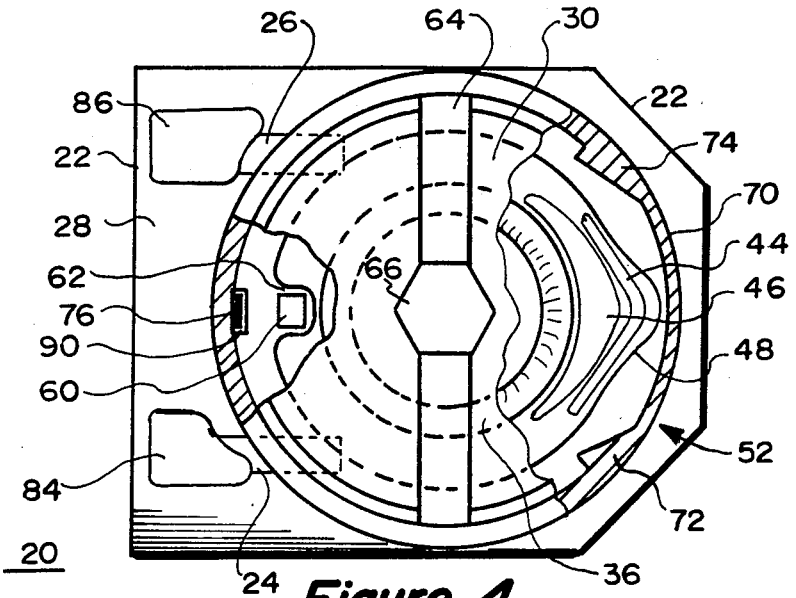
FIG. 4 is a plan view of the rotary switch of FIGS. 2 and 3—partially broken away to highlight certain features of the actuating knob.
Figure 5:
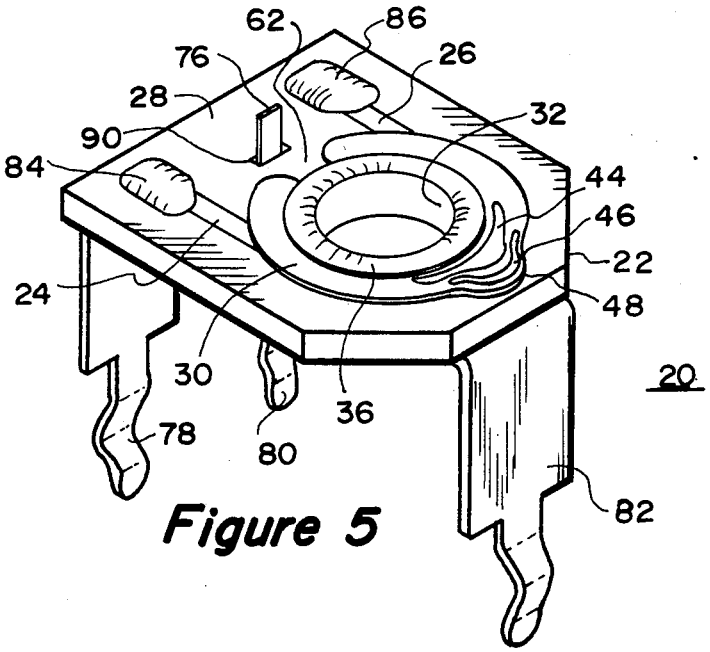
FIG. 5 is a partial perspective view of the rotary switch of FIGS. 2, 3 and 4 without the actuating knob.

Referring to FIGS. 2–5, a rotary switch 20, in accordance with this invention, includes a non-conductive terminal board 22 having first and second electrical output terminals 24 and 26 in the form of respective metal pads disposed on the top side 28 thereof. The output terminals 24 and 26 are discrete—i.e., electrically disconnected from each other as depicted in FIGS. 4 and 5.

A dish-shaped, washer-like, conductive wiper element 30 is rotatably secured to the terminal board 22 by means of a conductive tubular sleeve or rivet 32. The terminal board 22 is provided with a through aperture 34 for receiving the tubular sleeve 32. The peripheral end portions of the tubular sleeve 32 are outwardly flared, or crimped, as indicated at 36 and 38, for holding the wiper element 30 in place. An inner rim portion 40 of the wiper element 30 is loosely sandwiched between the top surface 28 of the terminal board 22 and the flared top end portion 36 of the tubular sleeve 32. This arrangement allows relatively free rotation of the wiper element 30 about a central axis 42. The wiper element 30 serves as an input terminal.

As depicted in FIGS. 4 and 5, a peripheral portion of the wiper element 30 is provided with a pair of arcuate slits 44 and 46. The arcuate slits 44 and 46 facilitate formation of an outwardly extending and downwardly projecting end portion 48 of the annular wiper element 30. The spout-like end portion or tab 48 engages the first output terminal 24 and the second output terminal 26, when the wiper element 30 is respectively occupying a first end position and a second end position thereof. When the wiper element 30 is occupying a midrange position, as indicated in FIGS. 3–5, the rotary switch 20 is electrically open.

The wiper element 30 is equipped with a raised rim portion 50 that is elevated with respect to the terminal board 22 in order to avoid inadvertent closure of the rotary switch 20.

The rotary switch 20 further includes a non-conductive actuating knob or member 52, which is rotatably mounted on the terminal board 22—coaxially with respect to the wiper element 30. The actuating member 52 is provided with a downwardly projecting hollow shaft 54. The hollow shaft 54 is rotatably received in the central bore 56 of the tubular sleeve 32. The inserted end portion 58 of the hollow shaft 54 is outwardly flared to hold the actuating member 52 in place.

The actuating member 52 is provided with a downwardly depending tab portion 60, which is received in a peripheral recess 62 disposed in the wiper element 30. (See FIG. 4.) The tab portion 60 serves to mechanically couple the actuating member 52 with the wiper element 30, whereby the rotation of the actuating member is transmitted to the wiper element.

The actuating member 52 is provided with a pair of open-ended slots 64 and 66. The slot 64 is for a screw driver, and the slot 66 is for a hexagonal key. To position the wiper element 30, a tool is inserted into the respective one of the slots 64 and 66 and rotated clockwise or anticlockwise, as desired. On an automated TV assembly line, for example, the positioning of the rotary switch 20 is done robotically.

As can be seen from FIGS. 3 and 4, the actuating member 52 is equipped with a peripheral wall or skirt portion 70. The peripheral wall portion 70 is, in turn, provided with a pair of inwardly projecting rib portions 72 and 74, which are symmetrically disposed on either side of the outwardly extending end portion 48 of the wiper element 30. The rib portions 72 and 74 of the actuating member 52 are subject to engagement with a stop member 76 fixedly disposed on the terminal board 22. The spacing between the rib portions 72 and 74 relative to the outwardly extending end portion 48 of the wiper element 30 is such that when the actuating member 52 is rotated clockwise, as viewed in FIG. 4, the rib portion 72 engages the stop member 76 to ensure engagement between the end portion 48 and the first output terminal 24. When the actuating member 52 is rotated anticlockwise, the rib portion 74 engages the stop member 76 to cause the end portion 48 to contact the second output terminal 26. Thus the rib portions 72 and 74 of the actuating knob 52 coact with the stop member 76 to accurately position the wiper element 30 for optimal engagement with the output terminals 24 and 26.

In the embodiment shown in FIGS. 2–5, the peripheral wall 70 of the actuating member 52 consists of a plastic strip wrapped around the lower portion of the actuating member, and secured thereto by any suitable adhesive means (e.g., glue). Alternately, the peripheral wall 70 may be integrally molded with the plastic actuating member 52.

The rotary switch 20 additionally includes a set of three conductive and planar mounting lugs 78, 80 and 82. The lugs 78, 80 and 82 serve two useful purposes—they facilitate mounting of the rotary switch 20 to a printed circuit board (PCB) and they provide external electrical contacts for the metallic pads 24, 26 and the wiper element 30.

The mounting lugs 78 and 80 are secured to the terminal board 22 by inserting their respective ends into an associated pair of slots provided in the terminal board. The inserted ends of the mounting lugs 78 and 80 are soldered to the respective metal pads 24 and 26, as indicated at 84 and 86.

The mounting lug 82 is secured to the terminal board 22 by passing the tubular sleeve 32 through an opening in the lug 82, as depicted in FIG. 3. The mounting lug 82 is sandwiched between the bottom flared end 38 of the tubular sleeve 32 and the bottom surface 88 of the terminal board 22. An end portion of the mounting lug 82 extends through a slot 90 in the terminal board 22 to its other side to form the stop member 76.

Any suitable materials may be used for various components of the subject rotary switch. For example:

Terminal board 22—ceramic,
Metal pads 24 and 26—silver,
Tubular sleeve 32—brass with tin/lead electroplating,
Wiper contact element 40—nickel/silver compound,
Actuating knob 52—nylon, and
Mounting lugs 78, 80 and 82—brass with tin/lead electroplating.

The rotary switch 20, in accordance with this invention, is relatively inexpensive, provides a midrange no-connection position and is suitable for use in conjunction with automatic test and alignment equipment.

Figure 6:
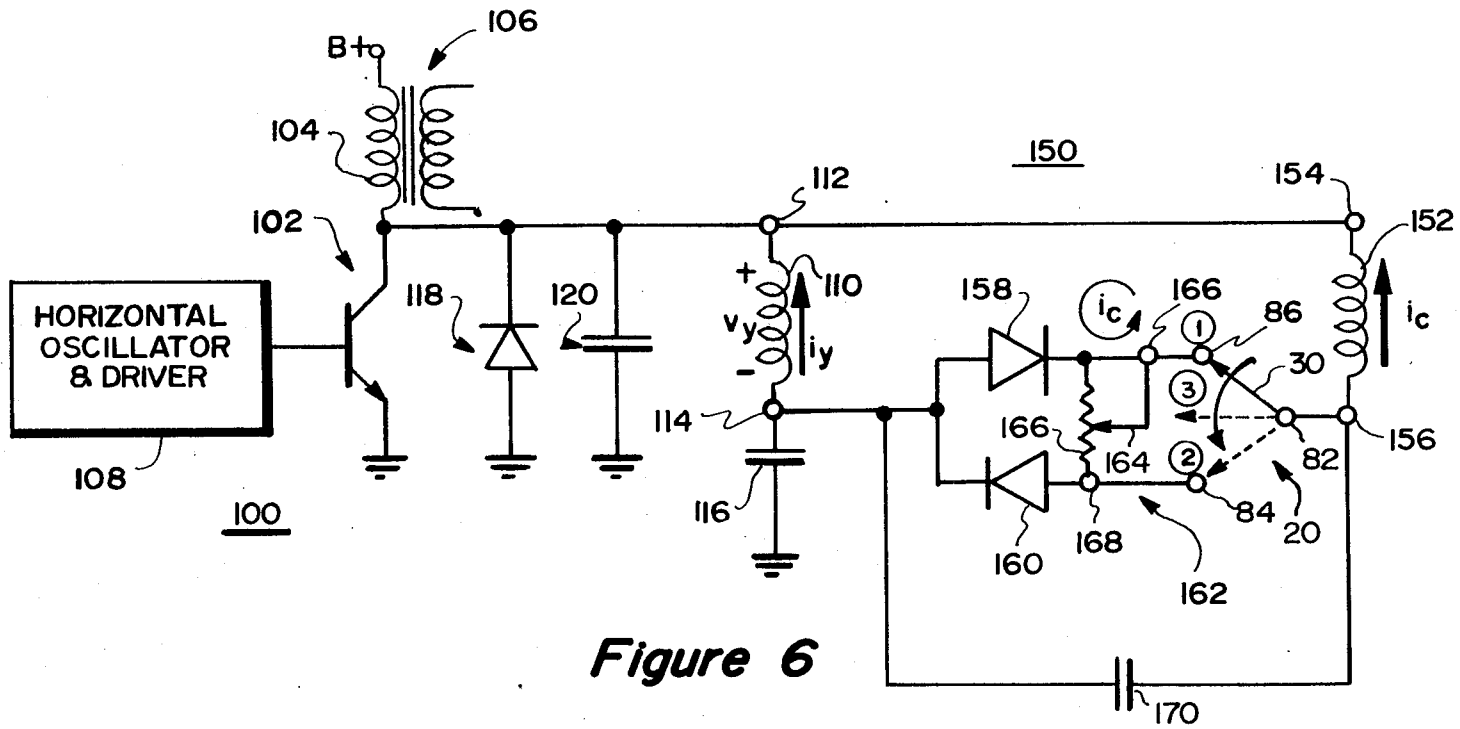
FIG. 6 shows the schematic diagram of a horizontal deflection system for a television receiver.

FIG. 6 shows a horizontal deflection system 100 for a television receiver, which includes a raster centering circuit 150 embodying this invention. The single pole double throw (SPDT) rotary switch 20 is used in the centering circuit 150 for establishing the polarity of the DC component of the centering current $i_c$ in the horizontal yoke winding 110. The direction of the DC component of the centering current $i_c$, in turn, determines whether the kinescope raster moves to the left or right relative to the opening in the television cabinet.

The collector of a switching transistor 102 is coupled to a B+ supply voltage (e.g., 110 volts) via the primary winding 104 of a horizontal flyback transformer 106. The emitter of the transistor 102 is coupled to ground. A horizontal oscillator and driver stage 108 provides a timing signal to the base of the transistor 102. The oscillator/driver stage 108 switches the transistor 102 off at the beginning of a retrace cycle, and readies it for conduction somewhat before the center of a trace cycle.

The horizontal yoke winding 110 has one terminal 112 coupled to the collector of the switching transistor 102. The other terminal 114 of the yoke winding 110 is coupled to ground via an S-shaping capacitor 116. A damper diode 118 and a retrace capacitor 120 are coupled, as shown, between the collector of the switching transistor 102 and ground.

Figure 7:
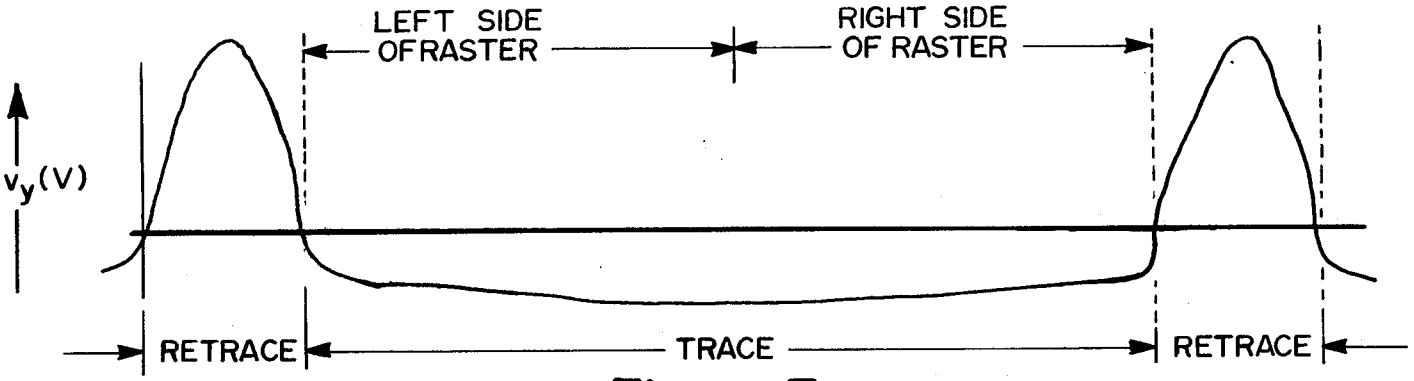
FIGS. 7, 8 and 9 are signal waveforms useful in understanding the FIG. 6 television deflection system.
Figure 8:
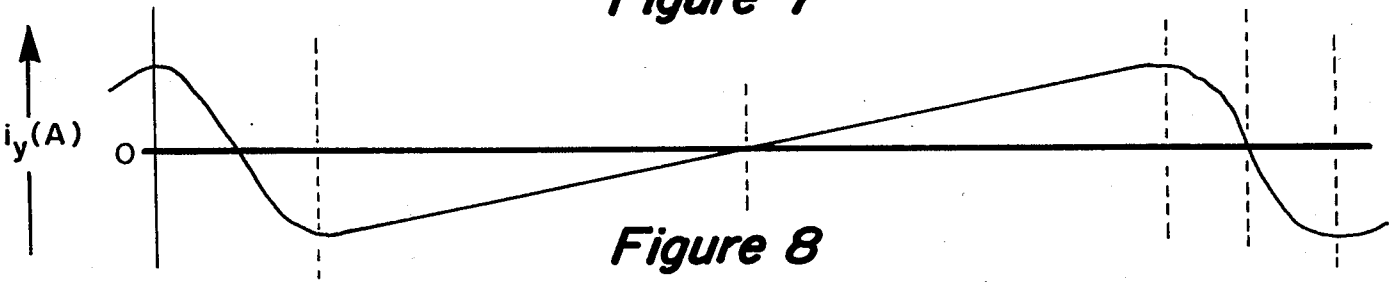

The operation of the deflection system 100 is represented by the waveforms in FIGS. 7 and 8. FIG. 7 depicts the voltage $V_y$ across the yoke winding 110. FIG. 8 represents the yoke current $i_y$. The reference directions for the yoke voltage $v_y$ and current $i_y$ are as shown in FIG. 6. During the first half of the trace cycle (i.e., the left side of the raster), the yoke current $i_y$ flows upwardly through the damper diode 118 and downwardly through the yoke winding 110. The yoke current $i_y$, which is negative maximum at the beginning of the trace cycle, decays to zero as the scanning electron beam approaches the center of the raster. During the second half of the trace cycle, the yoke current $i_y$ flows upwardly through the yoke winding 110 and downwardly through the switching transistor 102. The yoke current $i_y$ reaches its positive maximum when the electron beam reaches the right edge of the raster.

As the yoke current $i_y$ reaches its positive maximum, the oscillator/driver stage 108 shuts off the switching transistor 102, thereby diverting the yoke current to flow into the retrace capacitor 120. As the retrace capacitor 120 charges to its maximum value, the yoke current $i_y$ diminishes to zero. In the second half of the retrace cycle, the retrace capacitor 120 discharges, and the yoke current $i_y$ increases in the negative (i.e., downward) direction. The electron beam is returned to the left edge of the raster when the yoke current $i_y$ reaches its negative maximum.

As the electron beam scans horizontally at the horizontal scan rate (15,734), it is also deflected vertically by the television vertical deflection system at the vertical scan rate (60 Hz). The combination of the horizontal and vertical scanning of the electron beam produces a raster on the kinescope screen as is well known in the art.

The centering circuit 150 includes a centering coil 152, one terminal 154 of which is coupled to the terminal 112 of the yoke winding 110. The other terminal 156 of the centering coil 152 is coupled to the common terminal 82 of the SPDT switch 20. A pair of oppositely-disposed diodes 158 and 160 are coupled between the terminal 114 of the yoke winding 110 and the respective terminals 86 and 84 of the SPDT switch 20, as shown in FIG. 6. A variable resistor or potentiometer 162 is coupled across the terminals 84 and 86 of the SPDT switch 20.

The potentiometer 162 includes a movable contact or wiper element 164 and a resistance element 166. The position of the contact element 164 determines the resistance between the terminals 166 and 168 of the potentiometer 162. When the contact element 164 is in the uppermost position, the maximum resistance is interposed between the terminals 166 and 168. When the contact element 164 is in the lowermost position, the terminals 166 and 168 are shorted.

Figure 9:
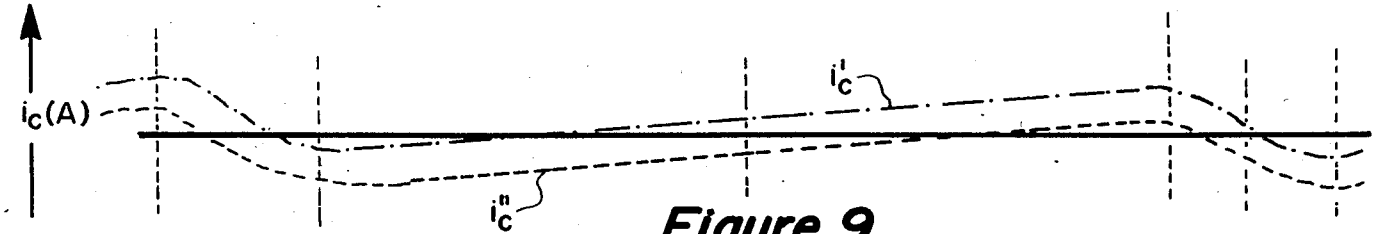

When the SPDT switch 20 is in the first position, the anticlockwise component of the centering current $i_c$ flowing from the terminal 114 of the yoke winding 110 to the terminal 156 of the centering coil 152 flows through the diode 158 and the SPDT switch without encountering any resistance. On the other hand, the clockwise component of the centering current (i.e., from the terminal 156 to the terminal 114) flows through the SPDT switch 20, the wiper element 164, a portion of the resistor 166 and the diode 160. Thus, the clockwise centering current $i_c$ encounters additional resistance when the SPDT switch 20 is in the first position. The net result is that the centering current $i_{c'}$ flowing through the yoke winding 110 has an anticlockwise DC component as shown in FIG. 9 when the SPDT switch 20 is in the first position. It will be noted that the waveforms of the centering current $i_c$ are the same as that of the yoke current $i_y$.

When the SPDT switch 20 is in the second position, the anticlockwise centering current $i_c$ encounters additional resistance for the same reasons. In this mode, the center current $i''_c$ flowing through the yoke winding 110 has a clockwise DC component.

The amount of resistance added to the return path depends upon the position of the contact element 164 of the potentiometer 162. Thus, the position of the contact element 164 determines the magnitude of the DC component of the centering current $i_c$, and the position of the SPDT switch determines the direction of the DC component (i.e., clockwise or anticlockwise). When the SDPT switch 20 is in the intermediate or open position 3, the return path for the centering current ic is provided by a bypass capacitor 170. In this mode the centering current $i_c$ has no DC component, and the raster is in its original position.

The rotary SPDT switch 20 is physically compatible with various kinescope bias potentiometers (e.g., 162) on the printed circuit board housing the kinescope centering circuit 150. This greatly facilitates automatic adjustment of an array of kine bias pots and the centering switch 20 by a common set of screwdrivers on an automated television assembly line.

What is claimed is:

1. A single pole double throw rotary electrical switch comprising:

a non-conductive terminal board having a central aperture;

first and second spaced-apart electrical terminals fixedly disposed on one side of said terminal board;

an electrically conductive washer-like wiper element;

a tubular rivet disposed in said central aperture for rotatably securing said washer-like wiper element to said one side of said terminal board for motion between a first end position and a second end position; said wiper element contacting said first terminal and said second terminal when occupying said first end position and said second end position respectively; said wiper element being electronically disconnected from either of said first and second terminals when occupying a midrange position between said end positions;

a common electrical terminal fixedly disposed on said terminal board and electrically coupled to said wiper element; and an actuating member having a shaft portion disposed within said tubular rivet; said actuating member being disposed on said one side of said terminal board and mechanically coupled with said wiper element for selectively positioning said wiper element with respect to said first and second electrical terminals.

2. The rotary switch defined in claim 1 wherein said washer-like wiper element has an outwardly extending portion for engagement with said first and second terminals.

3. The rotary switch defined in claim 1 wherein said washer-like element has (1) a raised rim portion that is spaced from said terminal board to ensure that said washer-like element does not accidentally contact said first and second terminals, and (2) a depressed tab for contacting said terminals.

4. The rotary switch defined in claim 1 wherein the peripheral end portions of said tubular rivet are outwardly flared to hold said washer-like element in place.

5. The rotary switch defined in claim 1 wherein the very end of said shaft portion of said actuating member inserted into said rivet is outwardly flared to rotatably secure it to said terminal board.

6. The rotary switch defined in claim 1 wherein said actuating member is additionally equipped with a downwardly extending tab portion, which is received in a peripheral recess provided in said washer-like element; said tab portion of said actuating member transmitting motion of said actuating member to said washer-like element.

7. The rotary switch defined in claim 1 wherein said actuating member is provided with an open-ended slot for receiving a tool therein for selectively positioning said washer-like element.

8. The rotary switch defined in claim 2 further including a stop member fixedly disposed on said one side of said terminal board between said first and second electrical terminals; wherein said actuating member is provided with a pair of rib portions symmetricly disposed on either side of said outwardly extending portion of said washer-like element; wherein said rib portions are spaced from each other such that when said actuating member is rotated in a first direction, a first one of said rib portions engages said fixedly-disposed stop member to cause said outwardly extending portion of said washer-like element to contact said first terminal, and such that when said actuating member is rotated in a second direction, a second one of said rib portions engages said fixedly-disposed stop member to cause said outwardly extending portion of said washer-like element to contact said second terminal.

9. A single pole double throw rotary electrical switch comprising:

a non-conductive terminal board having a central aperture;

first and second spaced-apart electrical terminals fixedly disposed on one side of said terminal board;

a stop member fixedly disposed on said one side of said terminal board between said first and second electrical terminals;

an electrically conductive washer-like wiper element having an outwardly extending portion;

a conductive tubular rivet disposed in said central aperture for rotatably securing said washer-like wiper element to said one side of said terminal board for motion between a first end position and a second end position; said outwardly extending portion of said wiper element contacting said first terminal and said second terminal when occupying said first end position and said second end position respectively; said wiper element being electrically disconnected from either of said first and second terminals when occupying a midrange position between said end positions;

a conductive mounting lug for providing external electrical contact for said wiper element; said mounting lug being secured to the other side of said terminal board by passing said conductive tubular rivet through an opening in said mounting lug, and sandwiching said mounting lug between said terminal board and an outwardly flared end portion of said tubular rivet; said conductive tubular rivet electrically connecting said mounting lug to said wiper element; and an actuating member having a shaft portion disposed within said tubular rivet; said actuating member being disposed on said one side of said terminal board and mechanically coupled with said wiper element for selectively positioning said wiper element with respect to said terminals; said actuating member being provided with a pair of rib portion symmetrically disposed on either side of said outwardly extending portion of said washer-like element; wherein said rib portions are spaced from each other such that when said actuating member is rotated in a first direction, a first one of said rib portions engages said fixedly-disposed stop member to cause said outwardly extending portion of said washer-like element to contact said first terminal, and such that when said actuating member is rotated in a second direction, a second one of said rib portions engages said fixedly-disposed stop member to cause said outwardly extending portion of said washer-like element to contact said second terminal.

10. The rotary switch defined in claim 9 wherein said mounting lug, disposed on said other side of said terminal board, has an end portion that protrudes from said one side of said terminal board through a slot therein to define said stop member disposed between said first and second electrical terminals.

11. The rotary switch defined in claim 10 further including an additional pair of conductive mounting lugs for providing external electrical contacts for said first and second terminals; wherein each one of said pair of mounting lugs is fixedly secured to said other side of said terminal board by inserting an end thereof through a slot in said terminal board and soldering the inserted end of said one lug to an associated one of said first and second terminals.

12. In a deflection system for generating a sawtooth-shaped deflection current in a yoke winding; said deflection system including a centering circuit coupled to said yoke winding for applying centering current having a DC component thereto; said centering circuit being provided with a single pole double throw (SPDT) rotary switch for determining the direction of said DC component of said centering current through said yoke winding; said SPDT switch comprising:

a non-conductive terminal board having a central aperture;

first and second spaced-apart electrical terminals fixedly disposed on one side of said terminal board;

an electrically conductive washer-like wiper element;

a tubular rivet disposed in said central aperture for rotatably securing said washer-like wiper element to said one side of said terminal board for motion between a first end position and a second end position; said wiper element contacting said first terminal and said second terminal when occupying said first end position and said second end position respectively; said wiper element being electrically disconected from either of said first and second terminals when occupying a midrange position between said end positions;

a common electrical terminal fixedly disposed on said terminal board and electrically coupled to said wiper element; and an actuating member having a shaft portion disposed within said tubular rivet; said actuating member being disposed on said one side of said terminal board and mechanically coupled with said wiper element for selectively positioning said wiper element with respect to said first and second electrical terminals.

13. The deflection system defined in claim 12 wherein said centering circuit comprises:

a centering coil having one terminal thereof coupled to a first terminal of said yoke winding and the other terminal thereof coupled to said common terminal of said SPDT switch;

a pair of oppositely-disposed diodes coupled between a second terminal of said yoke winding and the respective one of said first and second terminals of said SPDT switch; and a variable resistor connected across said first and second terminals of said SPDT switch.

14. The deflection system defined in claim 12 wherein said SPDT switch further comprises:

a stop member fixedly disposed on said one side of said terminal board between said first and second electrical terminals; and a pair of rib portions symmetrically disposed on said actuating member; said rib portions being spaced from each other such that when said actuating member is rotated in a first direction, a first one of said rib portions engages said fixedly-disposed stop member to cause said washer-like element to contact said first terminal, and such that when said actuating member is rotated in a second direction, a second one of said rib portions engages said fixedly-disposed stop member to cause said washer-like element to contact said second terminal.

* * * * *